US006283224B1

(12) United States Patent
Culver et al.

(10) Patent No.: US 6,283,224 B1
(45) Date of Patent: Sep. 4, 2001

(54) RETRACTABLE GROUND WORKING DEVICE

(75) Inventors: Larry G. Culver, Sherwood Park; Ray W. Gillard, Fort Saskatchewan, both of (CA)

(73) Assignee: Road Badger Inc., Edmonton (CA)

( * ) Notice: Subject to any disclaimer, the term of this patent is extended or adjusted under 35 U.S.C. 154(b) by 0 days.

(21) Appl. No.: 09/401,774

(22) Filed: Sep. 22, 1999

(30) Foreign Application Priority Data

Aug. 18, 1999 (CA) ..... 2280297

(51) Int. Cl.[7] ..... E02F 3/76
(52) U.S. Cl. ..... 172/685; 172/713
(58) Field of Search ..... 172/685, 713, 172/772, 772.5, 776, 620

(56) References Cited

U.S. PATENT DOCUMENTS 4,512,090 4/1985 Billings ..... 37/117.5
4,967,850 11/1990 Bargfrede et al. ..... 172/197
5,224,555 7/1993 Bain et al. ..... 172/772.5
5,259,692 11/1993 Beller et al. ..... 404/90
5,407,014 4/1995 Tranmer ..... 172/197
5,795,096 8/1998 Culver ..... 404/90

*Primary Examiner*—Christopher J. Novosad
(74) *Attorney, Agent, or Firm*—Anthony R. Lambert

(57) ABSTRACT

A ground working device formed of a frame having a lower surface, and plural individually retractable teeth secured to the frame and extending away from the surface in a ground contacting array. Teeth for the ground working device are formed as part of a retractable tooth assembly. A retractable tooth assembly preferably comprises a tooth carrier on one end of which a tooth is slidably mounted, and on the other end of which is mounted a tooth position fixative, with a position adjustable rigid link connecting the tooth position fixative and the tooth. The retractable tooth assembly preferably extends through the frame from a first side to a second side, the retractable tooth assembly being secured to the frame on the first side and the tooth forming a working end on the second side.

15 Claims, 4 Drawing Sheets

RETRACTABLE GROUND WORKING DEVICE

FIELD OF THE INVENTION

This invention relates to ground working devices.

BACKGROUND OF THE INVENTION

A road resurfacing unit is disclosed in U.S. Pat. No. 5,795,096 issued Aug. 18, 1998, which uses teeth to rip a gravel road prior to separating coarse material from fine material and depositing the coarse material on the fine material. A difficulty with the design disclosed in the patent is that the teeth tend to wear. While the teeth may be individually replaced, this is time consuming. The inventor has proposed a solution to the wear problem of ground working equipment such as the road resurfacing unit disclosed in U.S. Pat. No. 5,795,096.

SUMMARY OF THE INVENTION

Therefore, in one aspect of the invention, there is provided a ground working device, comprising a frame having a lower surface, and plural individually retractable teeth secured to the frame and extending away from the surface in a ground contacting array.

Teeth for the ground working device are, in another aspect of the invention, formed as part of a retractable tooth assembly. A retractable tooth assembly according to a further aspect of the invention preferably comprises a tooth carrier on one end of which a tooth is slidably mounted, and on the other end of which is mounted a tooth position fixative, with a position adjustable rigid link connecting the tooth position fixative and the tooth.

The retractable tooth assembly preferably extends through the frame from a first side to a second side, the retractable tooth assembly being secured to the frame on the first side and the tooth forming a working end on the second side.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

In this patent document, "comprising" means "including". In addition, a reference to an element by the indefinite article "a" does not exclude the possibility that more than one of the element is present.

Figure 1:
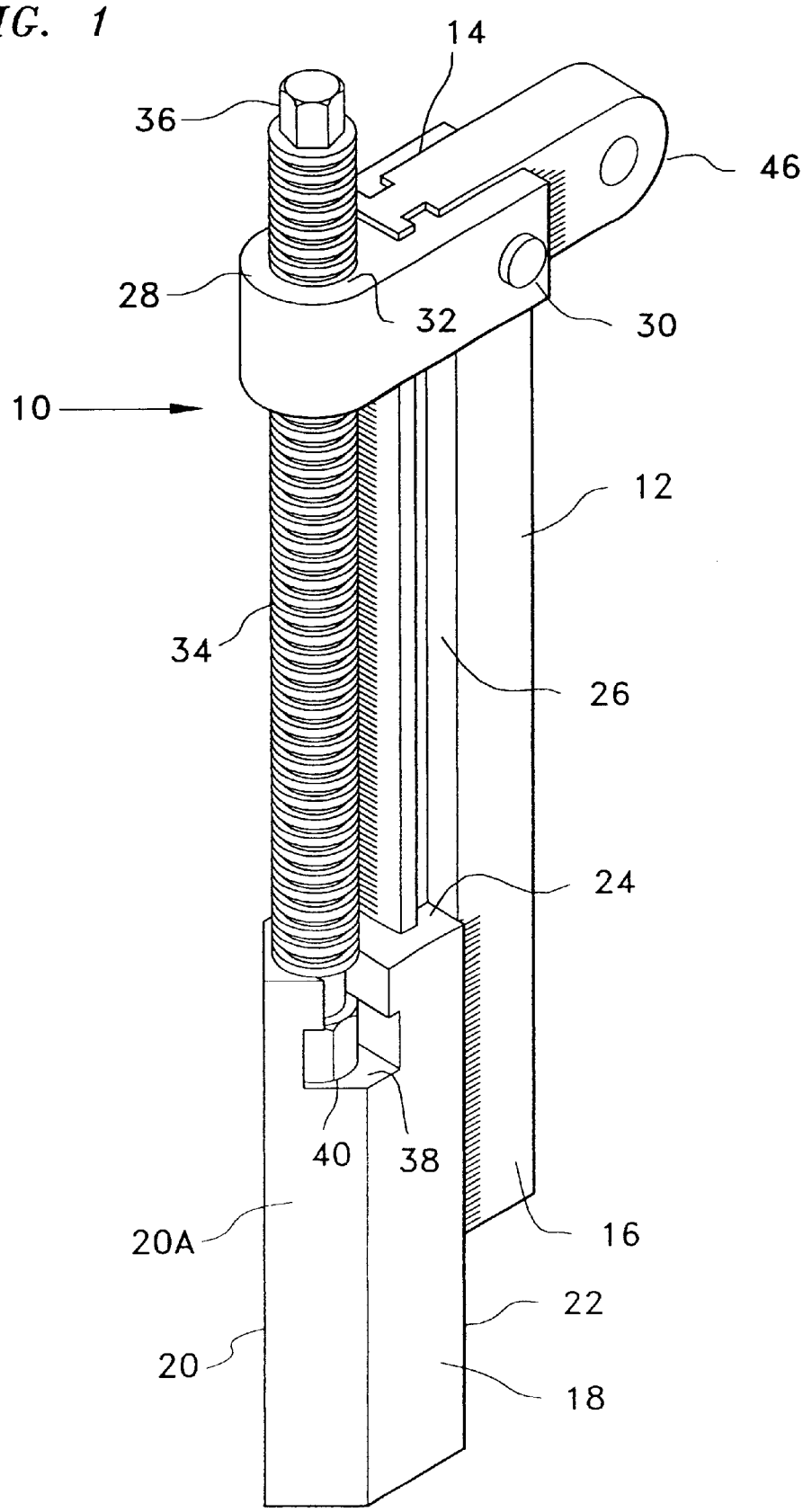
FIG. 1 is an isometric showing a retractable tooth assembly according to the invention.
Figure 2:
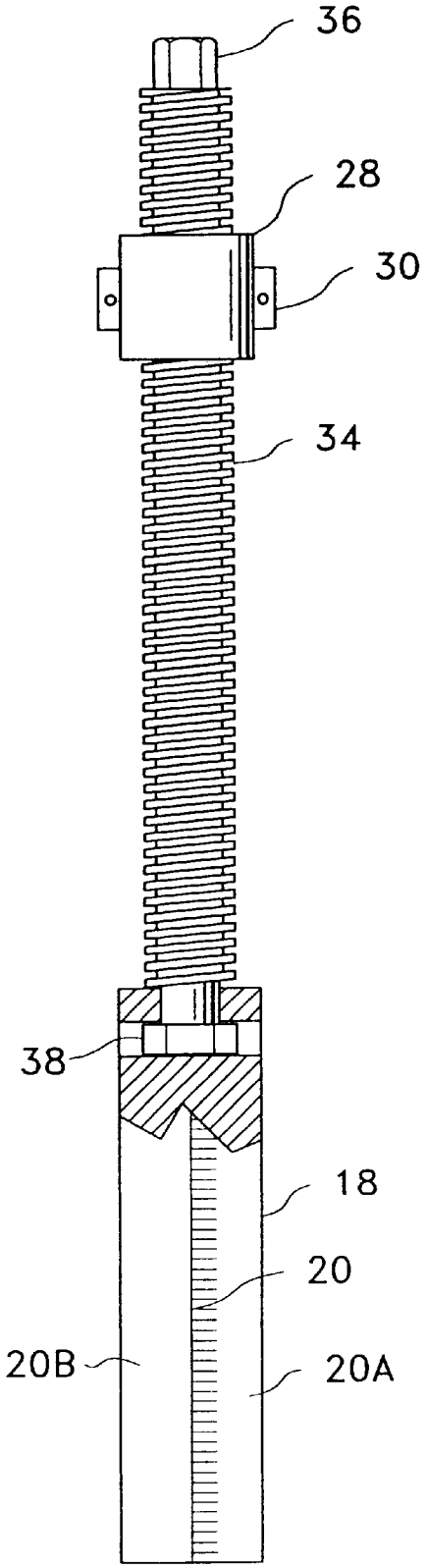
FIG. 2 is a rear view of the retractable tooth assembly of FIG. 1.
Figure 3:
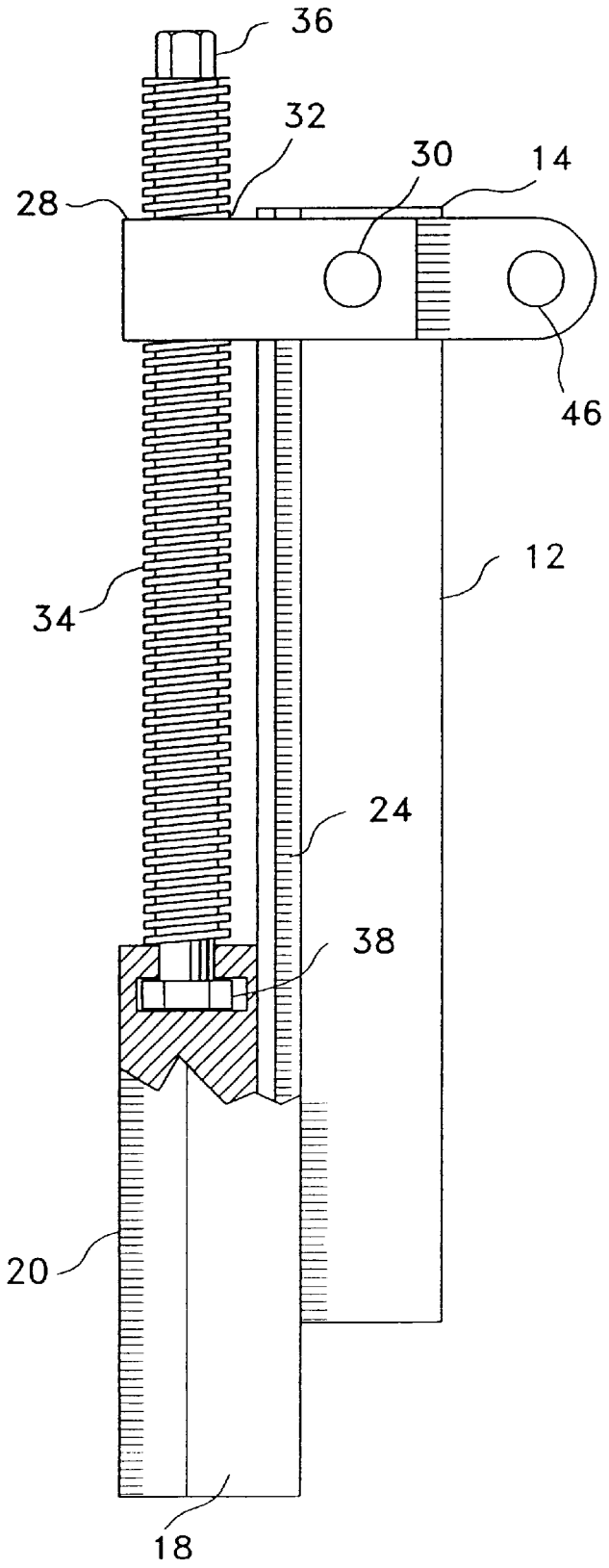
FIG. 3 is a side view of the retractable tooth assembly of FIG. 1.

Referring to FIGS. 1, 2 and 3, there is shown a retractable tooth assembly 10 according to the invention. The retractable tooth assembly 10 is formed of four main parts in the exemplary embodiment shown. First, there is a tooth carrier 12 having an upper end 14 and a lower end 16. Second, a tooth 18 is mounted for sliding on the lower end 16 of the tooth carrier 12. The tooth 18 has an edge 20, which in use is the forward edge that rips the ground. The edge 20 is formed of two faces 20*a*, 20*b* meeting at an apex. The tooth 18 also has a rearward edge 22 in which is formed a groove 24 for receiving a tongue 26 on the tooth carrier 12. The tooth 18 is preferably formed of a harder wearing material than the tooth carrier 12. The edge 20 should be made of the hardest material that is economical in the intended use, as for example tungsten carbide.

Third of the four main parts forming the retractable tooth assembly 10 is a tooth position fixative 28 at the upper end 14 of the tooth carrier 12. The tooth position fixative 28 is formed of a yoke member, securely attached to the tooth carrier 12 as by a bolt 30, with a bore 32 through the member for receiving a position adjustable rigid link 34 connecting the tooth position fixative 28 and the tooth 18. The position adjustable rigid link 34, the fourth main part in the retractable tooth assembly 10 is preferably a constant diameter screw with exterior threads that mate with interior threads in the bore 32. The end 36 of the position adjustable rigid link 34 is formed as a hex nut to allow working the screw through the bore 32. The end 38 of the position adjustable rigid link 34 is formed as a cap rotatably received by a slot 40 in the upper end of the tooth 18.

The tooth 18 is thus adjustably located on the tooth carrier 12 by rotating the hex nut at the end 36 of the position adjustable rigid link 34. As the tooth 18 wears, its height may be adjusted. The tooth 18 is the part that takes most of the wear in use of the retractable tooth assembly 10. By this design, the tooth 18 may be readily removed from the tooth carrier 12 by slipping the cap at the end 38 out of the slot 40, and sliding the tooth 18 off the tooth carrier 12.

Various other mechanisms may be used for the tooth position fixative 28 and position adjustable rigid link 34. The mechanism shown is a screw received by a threaded opening. Alternatively, such devices as a rack and pinion or worm and screw and other similar devices may be used to advance and retract the tooth 18 on the tooth carrier 12.

Figure 4:
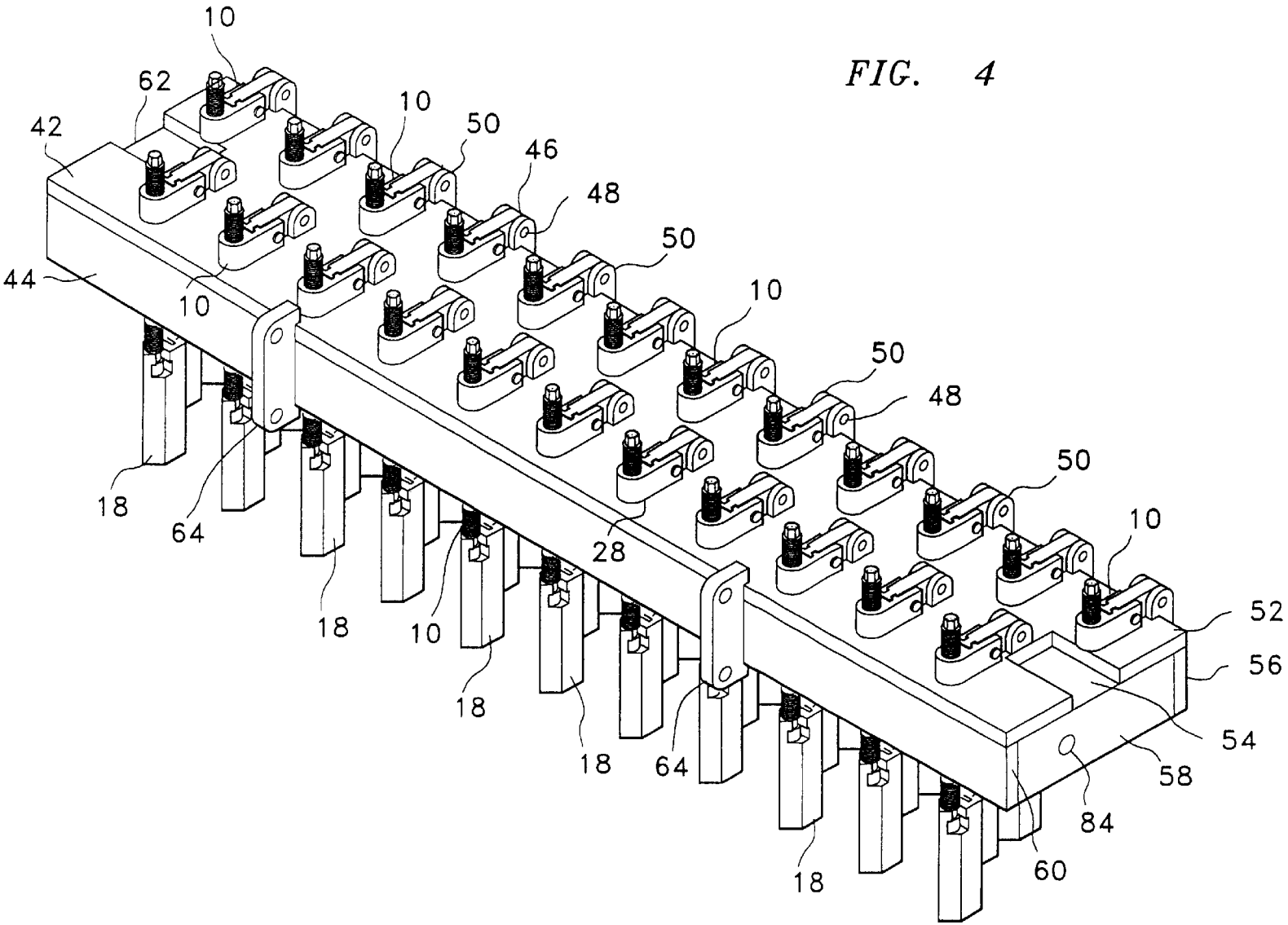
FIG. 4 is an isometric view of a ground working device with a retractable tooth assembly according to the invention.

A mount for the retractable tooth assembly 10 is shown in FIG. 4. The mount comprises a frame 42, which may be part of various ground working equipment such as a grader, farm implement or a road working device of the type shown in U.S. Pat. No. 5,795,096 of Culver. The frame 42 has a lower surface 44, which is defined as the surface closest to the ground when the frame 42 is in working position. Teeth 18 are secured to the frame 42 and extend away from the surface 44 in a ground contacting array. The teeth 18, made as shown in FIGS. 1, 2 and 3, are individually retractable. Preferably, the teeth 18 are arranged in a rectangular array as shown, with many more teeth across the width than there are rows of teeth. Each tooth 18 is formed as part of a retractable tooth assembly 10, which extends through the frame 42 from the upper side of the frame 42 to the lower side. The retractable tooth assembly 10 is secured to the frame 42 on the first side and the tooth itself forms a working end on the second side.

The retractable tooth assembly 10 may be secured to the frame 42 using the tooth position fixative 28. The tooth position fixative 28 may for this purpose include a bar 46 secured to a shaft 48 extending between two posts 50 that are welded or otherwise secured to the frame 42. The frame 42 is formed of an upper plate 52 and lower plate 54 secured together as by welding around their peripheries by plates 56, 58, 60 and 62. Mounting bars 64 are used to secure the frame 42 to the rest of the ground working equipment, such as a grader or the road resurfacing unit shown in U.S. Pat. No. 5,795,096.

Immaterial modifications may be made to the invention described here without departing from the essence of the invention.

The embodiments of the invention in which an exclusive property or privilege is claimed are defined as follows:

1. A ground working device, comprising:

a frame having a lower surface; and plural individually retractable teeth secured to the frame and extending away from the lower surface in a ground contacting array.

2. The ground working device of claim 1 in which the teeth are arranged in a rectangular array.

3. The ground working device of claim 1 in which the teeth are each formed as part of a retractable tooth assembly that extends through the frame from a first side to a second side, the retractable tooth assembly being secured to the frame on the first side and having a working end on the second side.

4. The ground working device of claim 1 in which each of the teeth is formed as part of a retractable tooth assembly and each retractable tooth assembly comprises:

a tooth carrier having first and second ends;

a tooth mounted for sliding on the second end of the tooth carrier;

a tooth position fixative at the first end of the tooth carrier; and a position adjustable rigid link connecting the tooth position fixative and the tooth.

5. The ground working device of claim 4 in which the teeth extend through the frame from a first side to a second side, the tooth position fixative being secured to the frame on the first side and the tooth extending from the frame on the second side.

6. The ground working device of claim 4 in which the tooth position fixative comprises a member having a bore for receiving the position adjustable rigid link.

7. The ground working device of claim 6 in which the position adjustable rigid link comprises a rod having exterior threads and the bore of the tooth position fixative has interior threads.

8. The ground working device of claim 7 in which the tooth has a forward edge and a rearward edge, and the forward edge comprises a pair of faces meeting at an apex.

9. The ground working device of claim 8 in which the rearward edge of the tooth has a groove for receiving a tongue on the tooth carrier.

10. The ground working device of claim 4 in which the tooth position fixative comprises a bar secured to a shaft between two posts.

11. A retractable tooth assembly for use in ground working devices, the retractable tooth assembly comprising:

a tooth carrier having first and second ends;

a tooth mounted for sliding on the second end of the tooth carrier;

a tooth position fixative at the first end of the tooth carrier; and a position adjustable rigid link connecting the tooth position fixative and the tooth.

12. The retractable tooth assembly of claim 11 in which the tooth position fixative comprises a member having a bore for receiving the position adjustable rigid link.

13. The retractable tooth assembly of claim 12 in which the position adjustable rigid link comprises a rod having exterior threads and the bore of the tooth position fixative has interior threads.

14. The retractable tooth assembly of claim 13 in which the tooth has a forward edge and a rearward edge, and the forward edge comprises a pair of faces meeting at an apex.

15. The retractable tooth assembly of claim 14 in which the rearward edge of the tooth has a groove for receiving a tongue on the tooth carrier.

* * * * *